United States Patent [19]

Mo

[11] 3,990,254

[45] Nov. 9, 1976

[54] MARINE STRUCTURE FOR OFFSHORE ACTIVITIES

[76] Inventor: Olav Mo, Gronsundveien 94, Nesbru, Norway

[22] Filed: Mar. 27, 1975

[21] Appl. No.: 562,398

[30] Foreign Application Priority Data

Mar. 29, 1974 Norway ..... 1145/74
Dec. 3, 1974 Norway ..... 4362/74

[52] U.S. Cl. ..... 61/101
[51] Int. Cl.[2] ..... E02B 17/00
[58] Field of Search ..... 61/46.5, 46; 114/.5 T, 114/.5 D; 175/9

[56] References Cited

UNITED STATES PATENTS 3,434,293 3/1969 Brown ..... 61/46.5
3,769,803 11/1973 Finney ..... 61/46.5
3,863,457 2/1975 Hafskjold ..... 61/46.5

*Primary Examiner*—Jacob Shapiro
*Attorney, Agent, or Firm*—Larson, Taylor and Hinds

[57] ABSTRACT

A marine structure for the handling of liquids such as hydrocarbons comprises a substructure including a plurality of cells. A watertight superstructure extends upwardly from at least one but preferably some of the cells to a height above sea level whereat it supports a deck structure. Within one of the cells which includes a superstructure a column is formed, which column extends upwardly from the bottom of the cell to a substantial height, preferably above sea level, and is arranged such that at least an upper portion of the space within the column located below sea level is kept dry so that machinery or the like can be stored thereat. Pipes extending upwardly from the cells can be formed integrally with and even in the walls of the column. The column may extend all the way to the deck.

11 Claims, 9 Drawing Figures

MARINE STRUCTURE FOR OFFSHORE ACTIVITIES

The present invention relates in general to a marine structure, preferably designed for drilling after and/or production of hydrocarbons in marine surroundings. More particularly, the present invention relates to a partly or fully submerged structure comprising one or more cells and further comprising a pipe arrangement for transport of fluids, such as for example oil, gas or water. The term "fluids" as used herein encompasses also slurries and any other state of matter which can be transported through a conduit.

Present developments in the offshore oil and gas industry have proved that the drilling and production of subaqueous mineral deposits will increase significantly in the near future and will be extended to sites further from shore. The production of fluid minerals from these sites creates many new problems, not the least of which is that of storing of a produced fluid until it can be transported away. As the sites for the production of subaqueous mineral deposits move further and further from shore, and because of the large depths, the expenses involved in laying product pipelines on the sea bed from the offshore production units to shore will increase considerably. The present developments have therefore gone towards partially or fully submerged structures, serving as oil storage units at an offshore production site. These structures are preferably of the type which is designed to be towed out to a desired location where they are fully submerged and placed on the sea bed or partly submerged to a semi-submerged position. The structures comprise therefore one or more cells which serve as both ballast and/or storage compartments. Therefore, a complicated pipe arrangement for supplying or removing ballast, for transportation of hydrocarbons from an oil source to the storage tanks, for transportation of hydrocarbons from the storage tanks to shore, or for ventilation of the storage tanks, etc. is required.

Also, because the oil activities have reached offshore areas with large shipping volumes, a structure where the possibilities of oil leakages because of collision with a ship or because of blow out are reduced, is required.

A marine structure according to the present invention is preferably made of concrete. It should be noted, however, that the structure alternatively may be made of steel. The structure is preferably of the type comprising a fully or partly submerged caisson with a superstructure projecting up from the caisson and up above the sea level, when in operational position supporting a deck structure. The structure may, however, be of any other suitable form or type.

It has been proposed to provide an oil production platform with tanks to accumulate oil for delivery to oil tankers or barges which ply between the production platform and the shore facilities, and it has been proposed to use either semisubmersible structure or a gravity structure for such a purpose. From U.S. Pat. No. 3,507,233 a semi-submersible vessel for production of oil is known. The vessel includes a concrete hull having oil storage chambers and buoyancy compartments. Upstanding stabilizing columns are mounted on the hull on opposite side of the pitch and roll axes of the vessel, one or more of which support a working platform in spaced relation above the hull. The columns extend vertically and the platform is spaced above the hull a distance greater than the maximum anticipated wave height. The hull buoyantly supports the vessel with the hull having freeboard. At the site, the storage chamber is ballasted with sea water to submerge the hull and portions of the stabilizing columns. Oil from the production site is pumped into the storage chamber to displace the water from the chamber. For this reason the vessel is equipped with a complicated pipe arrangement in order to obtain communication between the different storage and ballast tanks and the oil intake and the oil discharge outlet. The pipe arrangement forms a unit in spaced relation to the concrete structure of the main hull.

From U.S. Pat. No. 3,486,343, a drilling platform is disclosed, which is adapted to be floated to and sunk at an offshore location. The platform includes pontoons at the base for floating it to an offshore location and for engaging the ocean floor when the platfrom is sunk.

An upright column extend above the surface of the water when the platform is sunk, supporting a deck structure. The pontoons include separate water compartments, which may be filled with water to adjust the orientation of the platform as it floats or to sink the platform until the pontoons are seated on the ocean floor. The platform is provided with a ballasting system comprising tubes, valves and pumps which together form a unit in spaced relation to the walls of the hull.

It has also been proposed to use a pipe arrangement formed of steel pipes where the major portions of the pipes are arranged in spaced relation with the cell walls, forming a separate unit. Because the pipe arrangement forms a separate unit in spaced relation with the cell walls, the pipe arrangement has to be installed after the completion of the cell walls. Further, on platforms of the "Condeep" type, it has been proposed to install pipe arrangements in spaced relation inside the columns in the superstructure or completely outside these columns. Because of such a location of the type of pipe arrangement, a large staff of plumbers and welders is required to stand by in order to install the pipe arrangement in due time, unless the building of the structure is to be delayed. This is a big waste of both time and resources. Further, because of work the conventional pipe arrangement, a detailed planning and coordination of the installation work is required in order to save both time and capacity of work and in order to reduce the possibilities of delay. The existing pipe arrangements display in addition certain other deficiencies, such as for example the need of repeating maintenance due to corrosion etc.

The object of the present invention is to remedy the various past defects and to provide a simple and reliable pipe arrangement which more or less needs no maintenance.

In accordance with the present invention there is provided a marine structure for drilling after and/or production of natural subaqueous deposits, the marine structure being preferably of a semi-submersible or of a gravity type.

The marine structure comprises a substructure formed by a number of cells and a superstructure projecting up from the substructure and up above the water level, the superstructure supporting a deck structure elevated above the sea level. The superstructure is preferably formed by lengthening one or more of the cells in the substructure, preferably forming a statical elongation of the cells in the substructure. The new and characteristic feature is that at least one of the cells in the substructure which is lengthened to form the superstructure, is equipped with an internal shaft or column, extending from the lower part of the cell(s) in the superstructure to a level above sea level.

According to a further new and characteristic feature the pipe arrangement is completely or partly formed within the walls of the shaft(s) as an integrated unit, these shafts being formed by means of slipforming.

Such a shaft or column with the pipe arrangement integrated in its walls is favourable because the pipe arrangement and the shaft may be formed simultaneously, preferably by means of slipforming. Said shaft may be extended such as to form a support for the deck structure. According to the present invention, the shaft(s) may form a so called "utility shaft," i.e. a shaft which projects up from the bottom structure of a cell in the substructure and which is designed to extend above the maximum liquid level in the extended cell(s) forming an internal, drained shaft inside the extended cell(s). The space outside the utility shaft may be used as a storage chamber for hydrocarbons or as a ballast compartment. The utility shaft is designed to house pumps and other kinds of equipment which are not designed to be immersed in liquid. Also, because of the utility shaft, access to the lower part of the cell(s) is obtained. According to a further characteristic, the space outside the utility shaft may communicate freely with the remaining cells in the substructure.

According to another embodiment of the present invention, the pipe arrangement may be arranged inside a thickened portion of the column wall, the thickened portion extending along the whole length of the column.

According to another embodiment of the present invention, the column is formed as a solid unit within which, the pipe arrangement is arranged or formed. The solid column may be posttensioned along its periphery in order to avoid tension in the concrete. The reinforcement may alternatively be effected by an outer tube or cylinder which is coaxial with the column, the space between the outer tube and the columns being filled with expanding concrete, whereby the column is subjected to compressive forces. The column may also be post-tensioned in either direction with normal steel strands.

By using a utility shaft inside one or more of the elongated cells in the superstructure, a drained shaft is obtained together with additional ballast and/or storage capacity. Further, because of the communication between the elongated cell(s) in the superstructure and the surrounding storage/ballast cells in the substructure, the pressure across the cell walls is balanced. This reduces the reinforcement and post-tensioning required in the cell walls. Further, the utility shaft is well suited to house the pipe arrangement, pumps and other equipment. By slipforming the columns containing the pipe arrangement at the same time as pouring of cell walls and the deck supporting superstructure, the total time required for building the structure is reduced. Also, the necessary complimentary work on the piping installation reduces to the connection of the pipes, which does not require so much time and effort. In addition, the costs of a pipe arrangement according to the present invention is reduced compared with the conventional pipe arrangement. This is mainly because concrete is used instead of steel and because the number of plumbers and welders required to install the present pipe arrangement is reduced due to the reduced number of metal parts in the arrangement. Further, because the pipe arrangement more or less is made of concrete, the possibilities of buckling are reduced and so is the possibility of corrosion and hence, the frequency of maintanance. The dimension of the pipes is not limited, whereby the internal diameter may be increased in order to increase the capacity of the arrangement and in order to avoid the "water hammer" effect in the pipe system.

The internal column of utility shaft may preferably extend upwards to the termination of the elongated cell(s) in the superstructure and serve as a structural support of the deck structure, whereby the deck structure still is supported even if a failure in the extendend cell wall should occur, for example due to a collision with a ship etc.

According to the present invention, the pipe arrangement may as an alternative be formed by using steel or plastic pipes which are included in the columns or shaft walls.

The above and other important features and advantages of the present invention may best be understood from the following detailed description, constituting a a specification of the same, when considering in conjunction with the annexed drawings, wherein.

Figure 1:
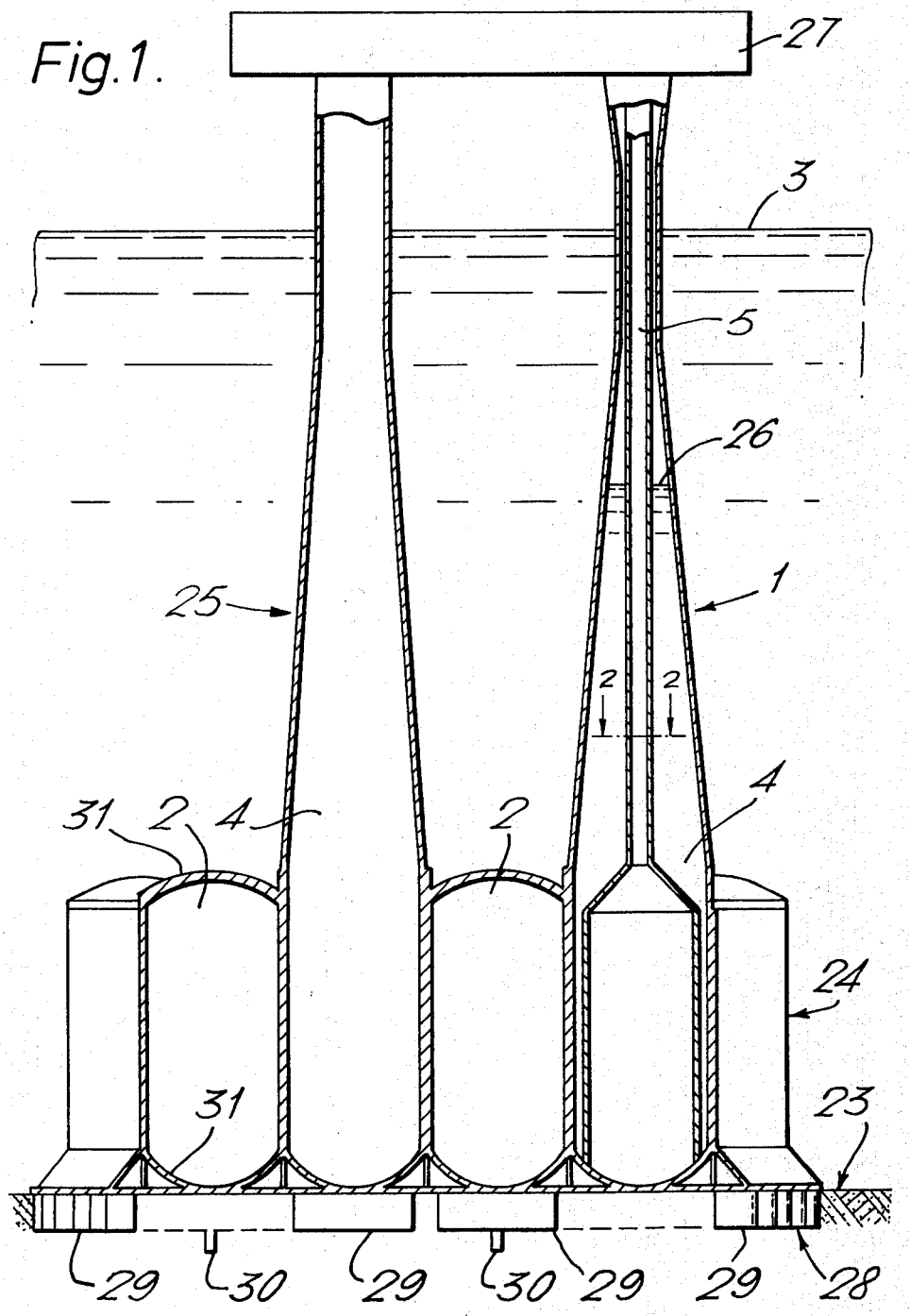
FIG. 1 shows a partly sectional side elevation of a platform of the gravity type.
Figure 9:
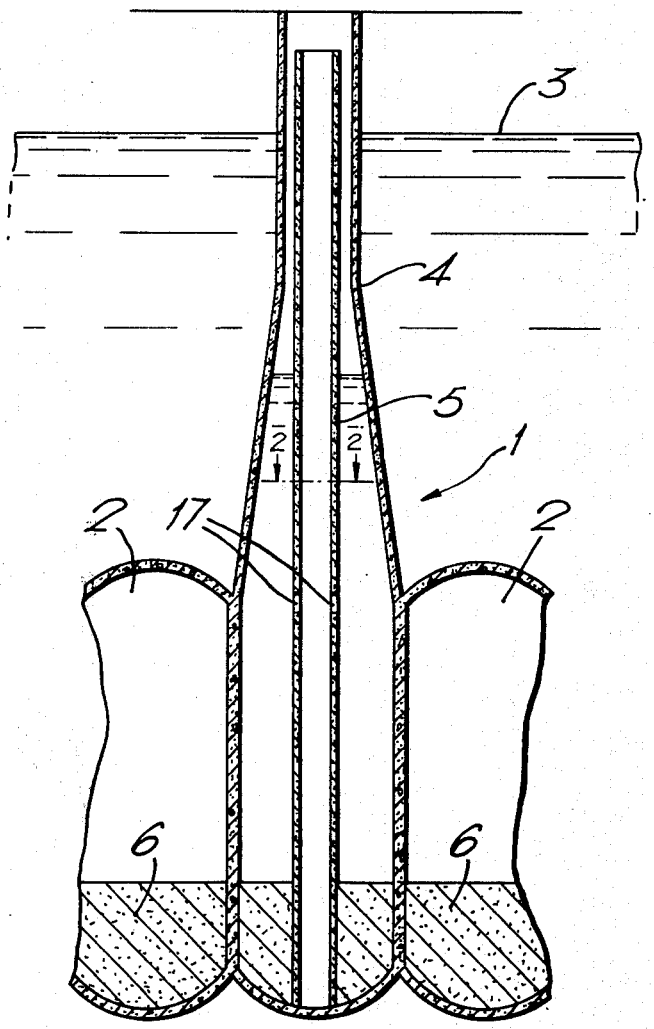
FIG. 9 shows a vertical section through the walls of one of the cells in the superstructure.

Referring now to the drawings in greater detail, the invention as illustrated particularly in FIGS. 1 and 9 takes the form of a gravity structure 1 resting on the sea bed 23. The platform comprises a substructure 24, formed as a caisson, a superstructure 25 projecting up from the substructure and up above the sea level 3, a deck structure 27 and a support 28.

The substructure 24 consists of a number of vertical elongated cells 2 having a circular cross-section area and being rigidly interconnected to form a monolithic unit. Two of the cells 4 are lengthened upwards, projecting above the sea level forming the superstructure 25, which at its upper end supports the deck structure 27. At the lower end, the substructure 24 is equipped with a downwardly extending and downwardly open support 28, the support 28 being preferably formed of a number of skirts 29. The support 28 is during the installation phase pressed down into the sea bed in order to support the structure stably. By using the skirts 29, the sliding surface moves down to a level where the mobilized shear forces normally will be far larger than in the surface layer. In addition, a passive earth pressure is achieved at the front edge and an active one at rear edge which together provide a substantial resistive force. In addition, frictional forces are obtained along the outer walls of the skirts lying parallel to the direction of the force. On the embodiment shown on FIG. 9, the lower end of each cell is filled with concrete, forming a concrete slab 6. The support 28 further comprises two or more "piles" 30 which project down from the substructure 24 and below the skirts 29. These piles 30 are rigidly connected to the substructure 24 and they are designed to reduce the horizontal movement of the platform during the submersion and penetrational stage of the installation. The piles are also designed to prevent skidding on the sea bed during installation.

The non-lengthened cells 2 in the substructure 24 are terminated at both ends by spherical shells or domes 31, while each of the cells 4 forming the superstructure 24, only is terminated with a dome at its lower end. The lengthened cells 4 are preferably formed as a statical elongation of the corresponding cell in the substructure.

A shaft or column 5 is placed centrally in at least one of the elongated cells 4 forming the superstructure 25. The shafts 5 shown on FIGS. 1 and 9 are tubular and they are designed to house pumps (not shown) and other kinds of machinery (not shown) which are not supposed to be immersed in water or other types of liquid. The shaft 5 extends therefore from the bottom end of the cell to above the water level 26 inside the elongated cell(s) 4, whereby a dry room is obtained. The shaft 5 extends preferably up to the termination of the cell wall as shown on FIG. 1. It should be noted, however, that the shaft 5 may terminate at a lower elevation, as shown on FIG. 9, and that the shaft does not have to be placed centrally in the cell 4. The walls of cells 2, 4 and the wall 7 of shaft 5 are preferably formed by using the slip forming technique. As shown on FIG. 9, a concrete slab 6 is poured on the bottom of the cells 2, 4. The slab 6 may be solid or it may be poured on top of a layer of sand (not shown).

The platform structure shown in FIGS. 1 and 9 is fitted with a pipe arrangement (not shown) for supplying and removal of ballast, hydrocarbons or other fluids. According to a preferred embodiment of the present invention, major parts of the pipe arrangement are formed inside the shaft walls 7.

Figure 2:
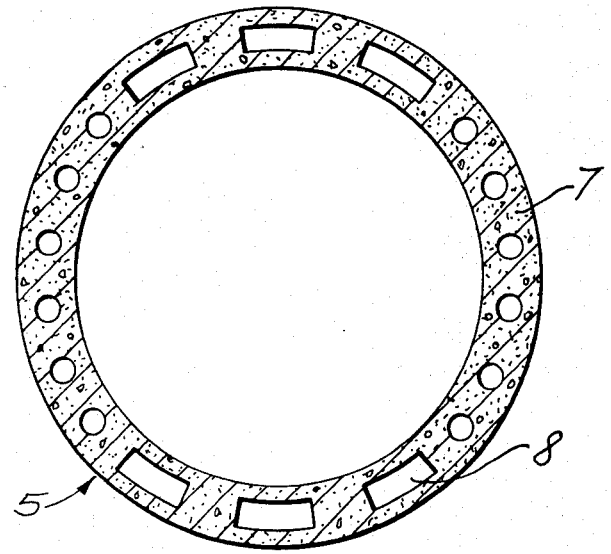
FIG. 2 shows a horizontal section taken along the line 2—2 on FIGS. 1 and 9.

FIG. 2 shows a horizontal section of the shaft 5 along the line 2—2 on FIGS. 1 and 9. According to FIG. 2 the shaft is cylindrical. It should be noted, however, that the shafts may have any other cross-sectional shape, such as square, polygonal etc., even through a cylindrical shape is preferred. Longitudinal conduits 8 with a square, circular or polygonal cross-section extend inside the shaft wall 7 along at least a portion of the shaft. Said conduits 8 constitute the vertical part of the pipe arrangement according to the present invention. The shaft wall 7 may for example be reinforced at least along its outer periphery and/or around the conduits in order to withstand the tensional forces caused by the fluid pressure inside the conduits 8.

Figure 5:
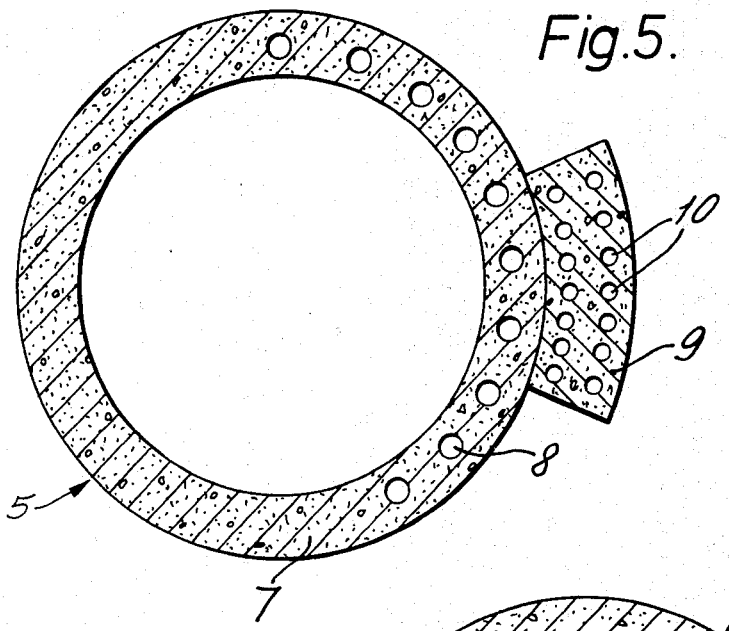
FIG. 5 shows a horizontal section through a utility shaft formed in accordance with a second embodiment of the present invention.

FIG. 5 shows a horizontal section through a second embodiment of the present invention. In addition to or instead of the conduits 8 in the shaft walls, conduits 10 are formed inside a thickened portion 9 of the column wall, the thickened portion extending along the entire length of the column.

Figure 6:
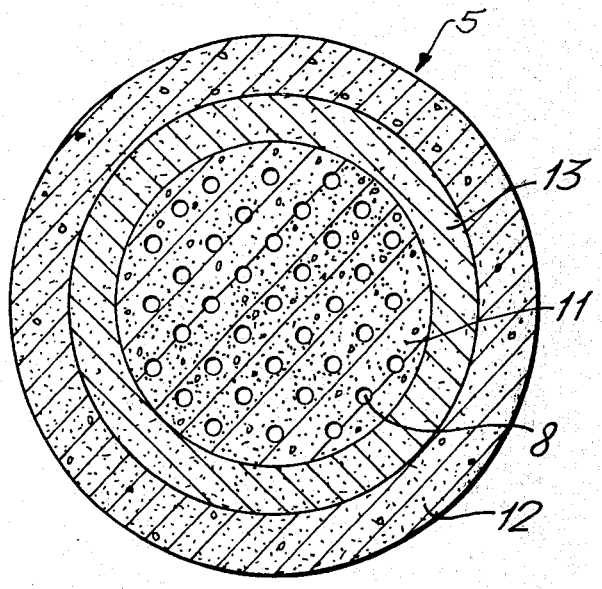
FIG. 6 shows a horizontal section through a utility shaft formed in accordance with a third embodiment of the present invention.

On FIG. 5, the thickened portion is added on to the outer wall. It should be noted, however, that the thickened portion very well may be added on to the internal wall. Also this embodiment is preferably formed by means of the slip forming technique. FIG. 6 shows a horizontal section through a third embodiment of the present invention. According to this embodiment, the shaft is formed as a solid column 11 containing the pipe arrangement. Reinforcement of the column is effected by an outer prestressed concrete tube or cylinder 12 which is placed co-axial with the columns. The internal diameter of the cylinder is larger than the diameter of the column, and the space 13 between the cylinder 12 and the column is filled with expanding concrete, whereby the column is subjected to compressive forces only. It should be noted that the cylinder 12 also may be made of metal and that other types of expanding materials may be used instead of the expanding concrete, or pressurized water.

The vertical part of the pipe arrangement shown on FIGS. 2, 5 and 6 is formed inside the concrete wall without using any steel tubes or other means as lining. It should be noted, however, that a pipe arrangement according to the present invention also may be formed by steel pipes which is cast into the concrete walls.

Figure 7:
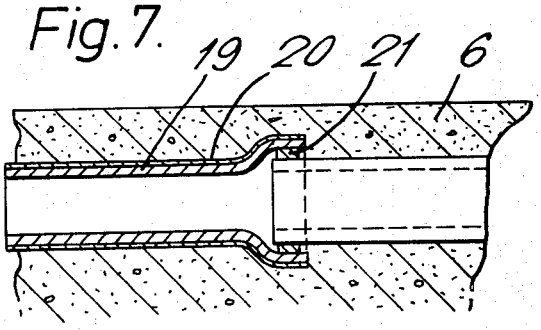
FIGS. 7 and 8 show a partly sectional view of tube or pipe connections, the pipes being included in a bottom slab in the lower section of the cell.
Figure 8:
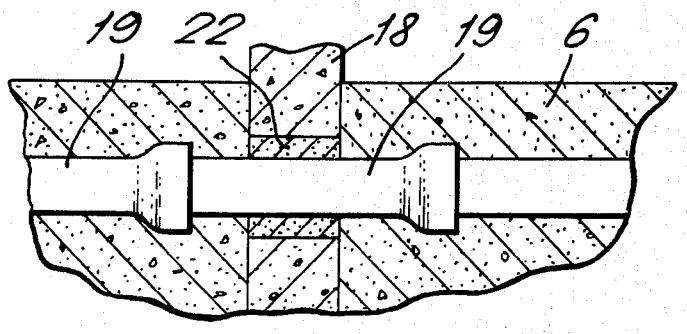

In the above, only the vertical parts of the pipe arrangement being cast into the shaft are described. This part of the pipe arrangement serves as a communication between the storage and ballast chamber and the deck structure. It is, however, necessary to have a communication between the shaft and the various cells. This communication may be formed by conventional steel pipes. These communication pipes may alternatively be formed as shown on FIGS. 7 and 8. According to these alternatives, the communicating pipes are cast into the slab 6 on the cell bottom. The communicating pipes are formed by standard sized concrete pipes 19 which are placed in a conventional way on the slab 6, using jointing compound in the joint and pouring ordinary reinforced concrete on top and around, this concrete being designed to take the tensile forces. Said concrete pipes 19 are preferably coated with an impermeable layer 20 of conventional type. FIG. 8 shows an alternative way to lay the communicating pipes through a cell wall 18. During the forming of the cell walls a hole is made in the wall where a communicating pipe is supposed to go through. The diameter of the hole is larger than the external diameter of the pipe.

When the casting of this part of the cell wall has terminated, a concrete pipe 19 is placed in the hole, extending through the hole. Concrete is thereafter filled in the remaining space 22 between the cell wall and the concrete pipe. The remaining concrete pipes are thereafter fitted in conventional manner. The concrete pipes can withstand a possible external liquid pressure and in addition, deformations due to applied loads and temperature variations are minimal. Further, by using concrete pipes the corrosion problems are avoided. In addition, the necessary complimentary work, is reduced to a minimum and the total costs are also reduced.

In the following, a proposed solution for connection communicating pipes of steel to the pipe arrangement in the shaft will be described.

Figure 3:
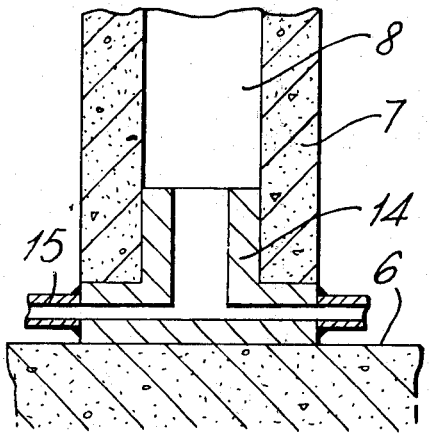
FIGS. 3 and 4 show in detail partial vertical sections through the wall of the utility shaft.

FIG. 3 shows in detail a vertical section through the wall of the utility shaft or through any vertical wall. A conduit 8 projects upwards from the lower end of the shaft wall 7. A T-formed steel socket 14 is cast in the wall 7 as shown on FIG. 3. The socket 14 forms a connection between the concrete conduit 8 and the connection steel pipes 15, the other end of which communicates for example with a ballast and/or storage compartment. The steel pipes 15 are preferably welded to an end flange on the T-formed steel socket. Instead of a T-formed socket, any multilegged socket may be used if necessary.

Figure 4:
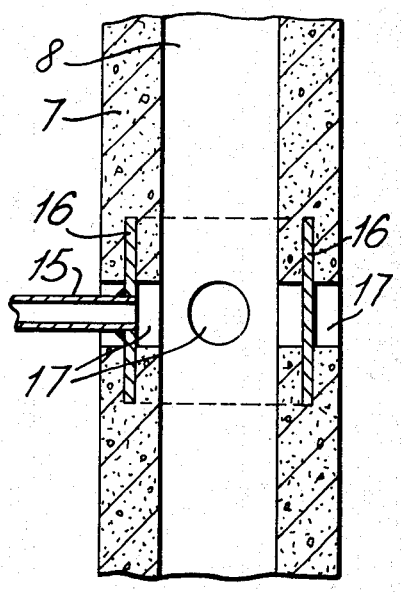

FIG. 4 shows in detail a vertical section through the shaft wall at a higher elevation. More particularly, FIG. 4 shows an alternative connection between the conduits 8 in the shaft and the communicating steel pipes 15. One or more holes 17 may be formed in the conduit wall. The holes 17 are closed with a steel plate 16 or the like which is cast into the conduit wall or shaft wall. If a steel pipe is to be connected to the conduit, a hole is cut in the steel plate 16 and the steel pipe 15 is welded on to the plate 16.

According to the present invention the cells 2, 4 and the shaft are cast at the same time; preferably using the slipforming technique. The conduits in the shaft are formed by fixing a plug for each conduit to the slipform. When concrete is poured into the form the conduits will be made as the slipform advances upwards.

In the above, a pipe arrangement being an integral part of the utility shaft is described. It should be noted, however, that the pipe arrangement alternatively may form an integrated part with any concrete wall, whether it be the cell walls or any other concrete walls or slab.

According to the present invention the interior of the utility shaft is kept dry, whilst the water level in the elongated cell 4, outside the utility shaft, is kept at the water head corresponding to the reduced pressure in the cells 2. The following advantages are thus produced:

1. Machinery and equipment may be installed in a dry room on deck structures which are supported by the wall of the utility shaft. Since said wall does not form a structural unit of the platform, the load acting on said wall is small and the design of the wall and the deck structures becomes less complicated in a statical sense.

2. No pressure difference between the walls separating the elongated cells 4 from the storage and/or ballast cells 2.

3. Due to the dry room, the machinery and equipment may be installed at an earlier stage.

4. Damages on the walls of the elongated cells, for example due to collision, will not cause a flooding in the utility shaft where machinery is installed.

5. The elongated cell(s) excluding the utility shaft, serves as a water tank for keeping a reduced water head in the storage and/or ballast cells.

I claim:

1. A marine structure comprising:

a substructure comprising at least one cell, said substructure constructed to be submerged beneath the surface of the sea level in operational positions of the marine structure, a watertight superstructure formed as an upward extension of said at least one cell, said superstructure extending to a height which would be above sea level in operational positions of the marine structure, a deck structure supported above the sea level by said superstructure, a column positioned internally within the at least one cell having the superstructure extending upwardly therefrom, said column extending from the bottom of its cell to a height at least above the top of the cell, said column being constructed and arranged to exclude water from at least an upper portion thereof located below sea level, even in the presence of some liquid in its said cell around the column, to provide a dry space below sea level for the storage of machinery, and pipe means for transporting liquid to and from said cell.

2. A marine structure according to claim 1, wherein the column extends above sea level.

3. A marine structure according to claim 1, said substructure including a plurality of cells, only some of which include said superstructure.

4. A marine structure as claimed in claim 1, wherein the pipe means includes vertical pipes transporting liquid between the cell and locations above sea level, and said vertical pipes being formed as an integrated part with the said column.

5. A marine structure as claimed in claim 4, wherein the vertical pipes are formed into the wall of the column as a part thereof.

6. A marine structure as claimed in claim 4, wherein the column is solidly formed and comprises an internal part containing the vertical pipes and a co-axial outer prestressed tube with an internal diameter larger than the diameter of the column, the space between the tube and the column being filled with an expanded material.

7. A marine structure as claimed in claim 1, wherein the column is terminated at the same elevation as the upper termination of the superstructure.

8. A marine structure as claimed in claim 4, wherein the vertical pipes are formed inside a thickened portion of the column wall.

9. A marine structure as claimed in claim 8, wherein the thickened portion extends on the outside of the column along its entire length.

10. A marine structure as claimed in claim 8, wherein the thickened portion extends on the inside of the column along its entire length.

11. A marine structure as claimed in claim 4, wherein the vertical pipes are cast into the wall of the column.

* * * * *